US005174397A

United States Patent [19]

Currington

[11] Patent Number: 5,174,397

[45] Date of Patent: Dec. 29, 1992

[54] SLIP GRIPPING MECHANISM

[75] Inventor: A. Ronald Currington, The Woodlands, Tex.

[73] Assignee: Baker Hughes Incorporated, Houston, Tex.

[21] Appl. No.: 703,014

[22] Filed: May 20, 1991

[51] Int. Cl.[5] ..... E21B 23/00; E21B 33/129

[52] U.S. Cl. ..... 175/423; 166/138; 166/217; 188/67

[58] Field of Search ..... 166/138, 212, 217, 206; 175/423; 188/67, 151 R, 151 A

[56] References Cited

U.S. PATENT DOCUMENTS

| | | | |
|---|---|---|---|
| 4,437,517 | 3/1984 | Bianchi et al. | 166/120 |
| 4,711,326 | 12/1987 | Baugh et al. | 188/67 |
| 4,732,212 | 3/1988 | Fraser, III | 166/217 X |
| 4,762,177 | 8/1988 | Smith, Jr. | 166/217 X |
| 4,876,230 | 3/1986 | Tapp et al. | 166/138 X |

OTHER PUBLICATIONS

Baker Service Tools 1988 Catalog, p. 55.

*Primary Examiner*—William P. Neuder

*Attorney, Agent, or Firm*—Charles D. Gunter, Jr.

[57] ABSTRACT

A slip gripping mechanism is shown for supporting a cylindrical conduit within the interior bore of a circumscribing conduit in a well bore. An outer body is provided as a part of the cylindrical conduit and has circumferentially spaced, longitudinally disposed slots. Axially shiftable slips are carried on the outer body of the cylindrical conduit in the slots with each of the slips having opposing side edges which engage mating profiles formed in the slots whereby the slots form guideways for the slips for shifting the slips axially and radially outward relative to the outer body between a set position engaging the circumscribing conduit and an unset position. Each of the axially shiftable slips has a lower surface and an upper gripping surface, the upper gripping surface being formed on a longitudinal radius as drawn from a center point located in a plane parallel to the central longitudinal axis of the cylindrical conduit.

10 Claims, 3 Drawing Sheets

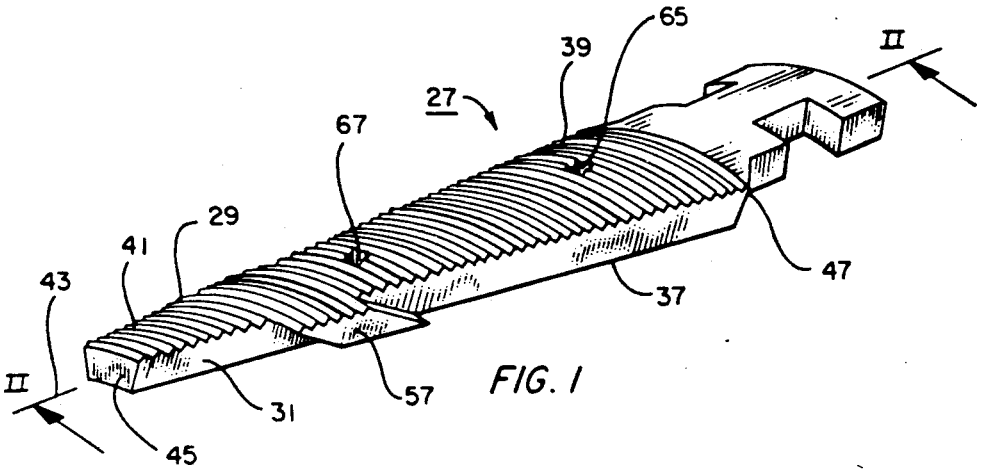
FIG. 1
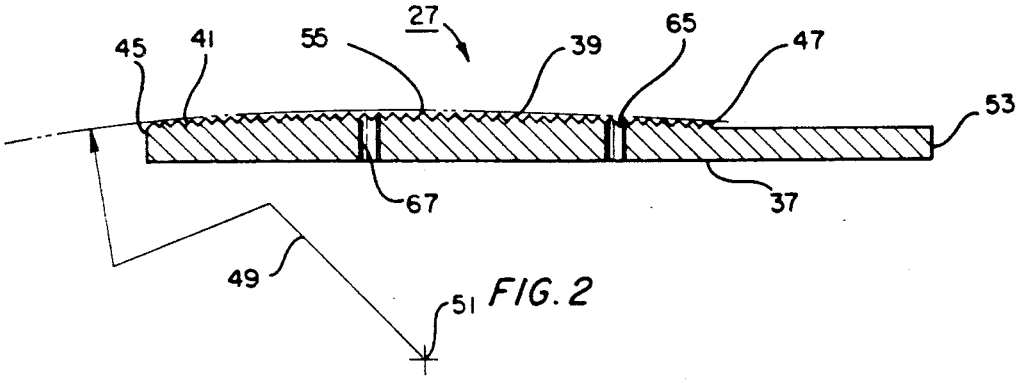
FIG. 2
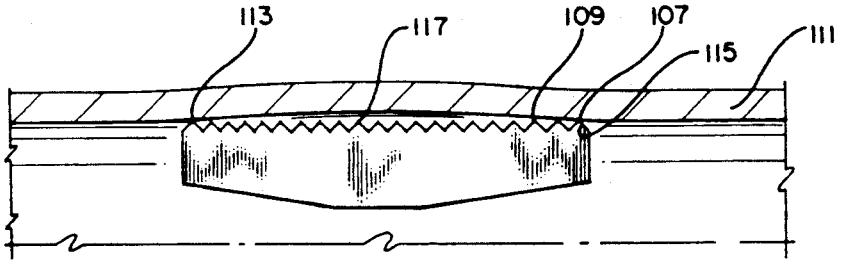
FIG. 3
PRIOR ART
FIG. 4
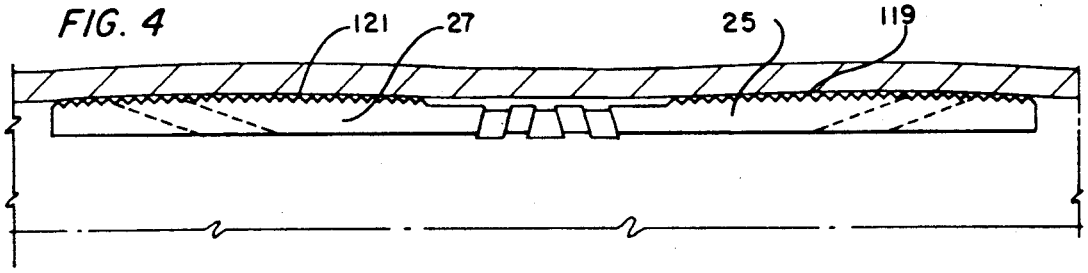

SLIP GRIPPING MECHANISM

BACKGROUND OF THE INVENTION

1. Field of the Invention

The present invention relates to improvements in well tools of the type having slip assemblies for grippingly engaging surrounding cylindrical conduits.

2. Description of the Prior Art

A variety of slip assemblies are shown in the prior art for use with well tools including well packers and liner hangers. These prior art devices are actuated in order to support a cylindrical conduit within the interior bore of a circumscribing conduit, typically the cased bore of a well. The prior art slip gripping mechanisms, in general, featured a plurality of wedge-shaped slip elements carried in circumferentially spaced-apart relationship about a generally conically shaped expander surface on the tool body. The lower surface portions of the slips were slidable over complimentary surfaces on the expander so as to cause wicker teeth on the upper surfaces of the slips to be moved between expanded and contracted positions in response to relative axial movement of the slip elements and expander. This relative movement was induced, for example, by hydraulic or mechanical actuation of telescopingly arranged, axially reciprocal members of the tool to which the slips and expander surface were connected.

One disadvantage of such prior art gripping mechanisms was that the loading imposed by the cylindrical conduit was transmitted radially from the expanders to the slips and radially outward into the surrounding well casing. An improvement to the prior art systems is shown in U.S. Pat. No. 4,711,326, issued Dec. 8, 1987, and assigned to the assignee of the present invention. In that device, a body was made up in the string of cylindrical conduit leading to the well surface which included a plurality of spaced, longitudinal slots. Vertically shiftable slips were carried in the slots by side edges which were designed to engage mating profiles formed in the slots. The slots formed guideways for the slips for shifting the slips upwardly and outwardly relative to the body between a set position engaging the circumscribing conduit and an unset position. That slip gripping mechanism allowed a string of cylindrical conduit to be supported within the interior bore of a circumscribing conduit by distributing the load being supported in a circumferential direction, rather than imposing a radial load, as in the prior art.

Despite the advantages of this improved design, a need continued to exist for a slip gripping mechanism which would distribute the slip loading as uniformly as possible over the gripping surface of the slip in order to minimize the resulting stress in the surrounding casing, especially under high load conditions.

A need has also continued to exist for an improved slip gripping mechanism with an improved geometry designed to reduce the setting force necessary to prevent movement of the slip as load was applied during the setting operation.

SUMMARY OF THE INVENTION

In order to reduce the required setting forces, the present design provides an improved slip geometry which is intended to reduce the number of gripping teeth which contact the casing at low applied setting loads. The improved slip design also distributes stress more evenly over the contact surface with the interior bore of the surrounding well casing by providing an outward configuration which conforms to the configuration of the stressed casing at heavy applied loads.

More specifically, the slip gripping mechanism of the invention is designed to support a cylindrical conduit having a central longitudinal axis within the interior bore of a circumscribing conduit in a well bore. The slip gripping mechanism includes an outer body which is made up as a part of the cylindrical conduit extending to the well surface. The outer body has a plurality of circumferentially spaced, longitudinally disposed slots. A plurality of circumferentially spaced, axially shiftable slips are carried on the outer body of the cylindrical conduit in the longitudinally disposed slots. Each of the axially shiftable slips has opposing side edges which engage mating profiles formed in the longitudinally disposed slots, whereby the slots form guideways for the slips for shifting the slips axially and radially outward relative to the outer body between a set position engaging the circumscribing conduit and an unset position. Setting means are provided for effecting the opposite relative motion between the outer body and the slips. Each of the axially shiftable slips has a lower surface and an upper gripping surface. The upper gripping surface of at least selected ones of the axially shiftable slips is formed on a longitudinal radius as drawn from a center point located in a plane parallel to the central longitudinal axis of the cylindrical conduit, giving the slip an outwardly bowed appearance.

Preferably, each of the axially shiftable slips has a lower surface and an upper gripping surface comprised by a plurality of rows of wicker teeth which run generally transverse to the longitudinal axis of the slip. The upper gripping surface thus provides an improved slip geometry having an external configuration which is preformed to conform as closely as possible to a section of well casing under a heavy applied load. As a result, the approximate center wicker of the upper gripping surface will tend to contact the surrounding conduit at a low applied load, thereby reducing the setting force required to set the slip gripping mechanism. At a high applied load, the upper gripping surface of the slips will tend to conform to the casing contour of the stressed casing to more evenly distribute the stress being applied and reduce the possibility of damage to the surrounding well casing.

Additional objects, features and advantages will be apparent in the written description which follows.

BRIEF DESCRIPTION OF THE DRAWINGS

FIG. 1 is a side, perspective view of the improved slip which forms a portion of the slip gripping mechanism of the invention;

FIG. 2 is a side, cross-sectional view taken along lines II.—II. in FIG. 1;

FIG. 3 is an isolated view of a prior art slip which schematically illustrates the uneven distribution of stress resulting from the setting operation;

FIG. 4 is a simplified, schematic view of a pair of the gripping slips of the invention showing the slips in the set position gripping the surrounding well casing;

DETAILED DESCRIPTION OF THE INVENTION

Figure 5A:
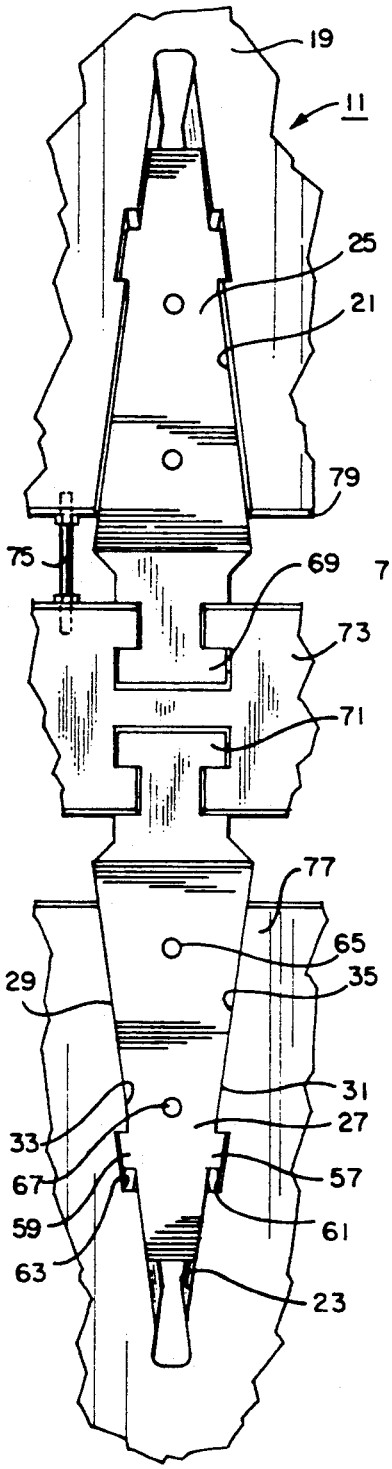
FIG. 5*a* is a top view of a portion of a well tool which utilizes the slip gripping mechanism, showing the slips of the invention in the running-in, unset position.
Figure 5B:
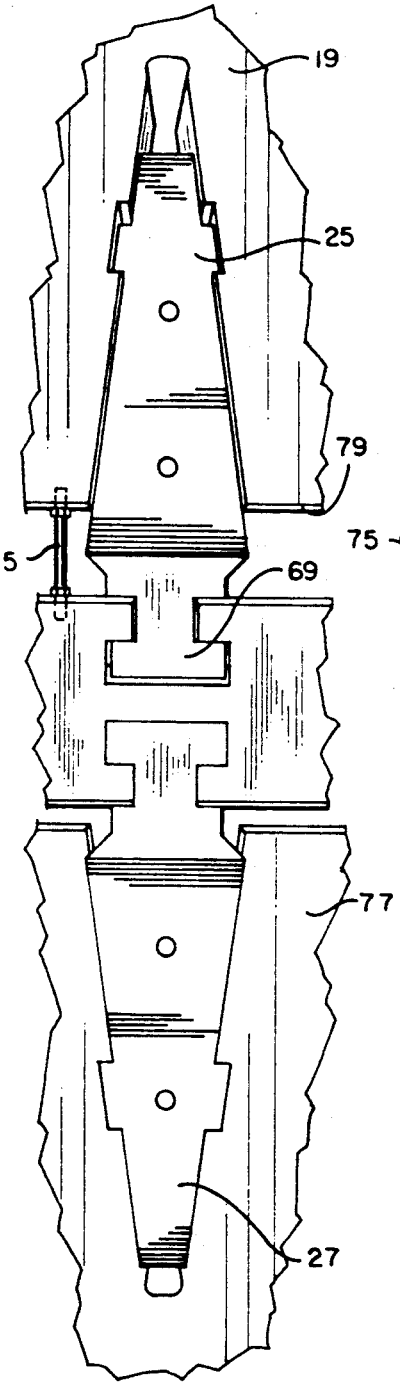
FIG. 5*b* is a view similar to FIG. 5*a* showing the initiation of the setting operation in which the bottom slip of the slip gripping mechanism is moved to the set position.
Figure 5C:
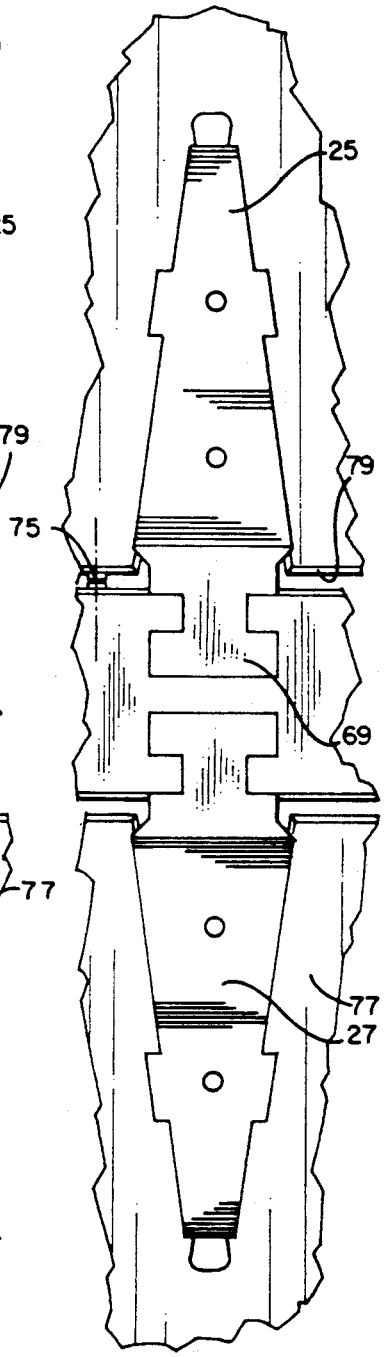
FIG. 5*c* is a view similar to FIG. 5*b* showing the continuation of the setting operation in which the upper slip is moved to the set position.

Turning first to FIGS. 5*a*–5*c*, there is shown a slip gripping mechanism of the invention designated generally as 11. The mechanism 11 is used for supporting a string of cylindrical conduit, a portion of which is illustrated as 13 in FIG. 6*a*, within the interior bore (15 in FIG. 6*a*) of a circumscribing conduit, typically a cased well bore. The cylindrical conduit 13 can be, for instance, a string of pipe, casing, tubing, liner, or the like of the type which extends downwardly from the earth's surface and which is to be suspended, by means of the gripping mechanism of the invention, within a cased well bore. The cylindrical conduit 13 has a central longitudinal axis (17 in FIG. 6*a*) and may extend for a length of several thousand feet.

As best seen in FIG. 5*a*, the cylindrical conduit 15 includes an outer body 19 provided as a part of the cylindrical conduit 13, the outer body having a plurality of circumferentially spaced, longitudinally disposed slots 21, 23. As will be appreciated from FIGS. 6*a* and 6*b*, the outer body 19 is typically made up in the string of cylindrical conduit leading to the well surface. For instance, the outer body can be one part of a well tool such as that shown in the co-pending application Ser. No. 07/574,435, filed Aug. 28, 1990, entitled PACK-OFF WELL APPARATUS AND METHOD, assigned to the assignee of the present invention and incorporated herein by reference. The slip gripping mechanism can also be utilized with a variety of similar well tools such as well packers and liner hangers which will be familiar to those skilled in the art. Each slip gripping mechanism includes a pair of identical, but oppositely arranged slips 25, 27 which are carried on the outer body 19 of the cylindrical conduit in the longitudinally disposed slots 21, 23. In the preferred embodiment of the tool, three or more slip gripping mechanisms of the type shown in FIG. 5*a* are circumferentially spaced at even intervals about the cylindrical conduit 13.

Figure 6A:
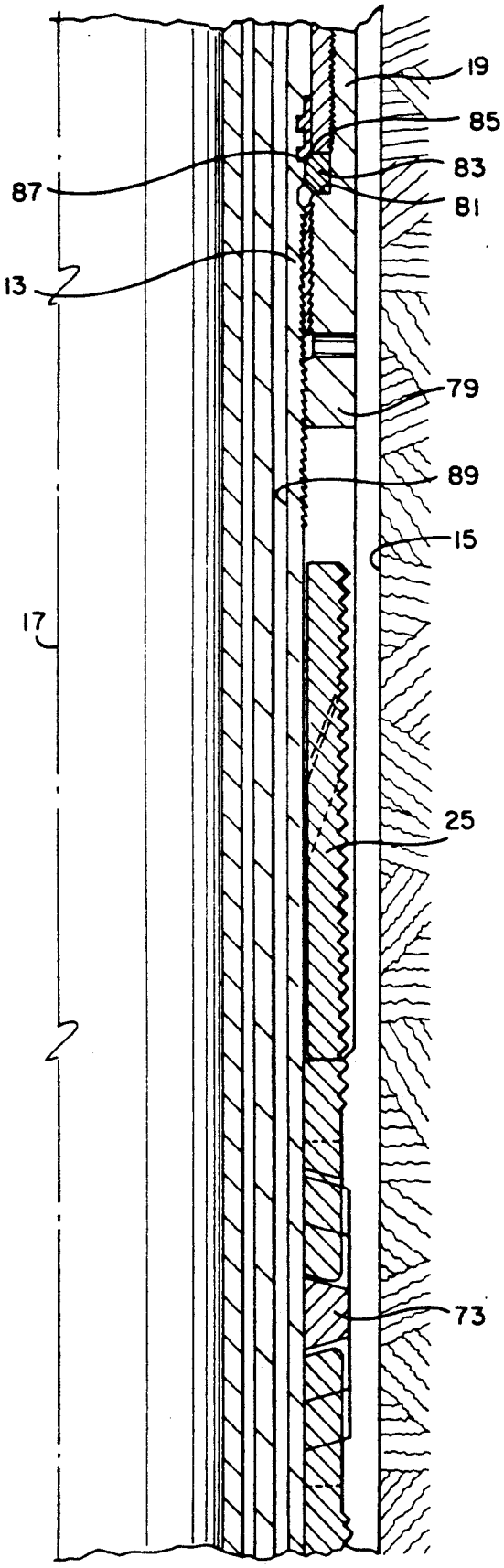
FIG. 6*a* is a quarter-sectional view of a well tool of the type employing the slip gripping mechanism of the invention, showing the setting means used to effect opposite relative motion between the outer body of the tool and the slips.
Figure 6B:
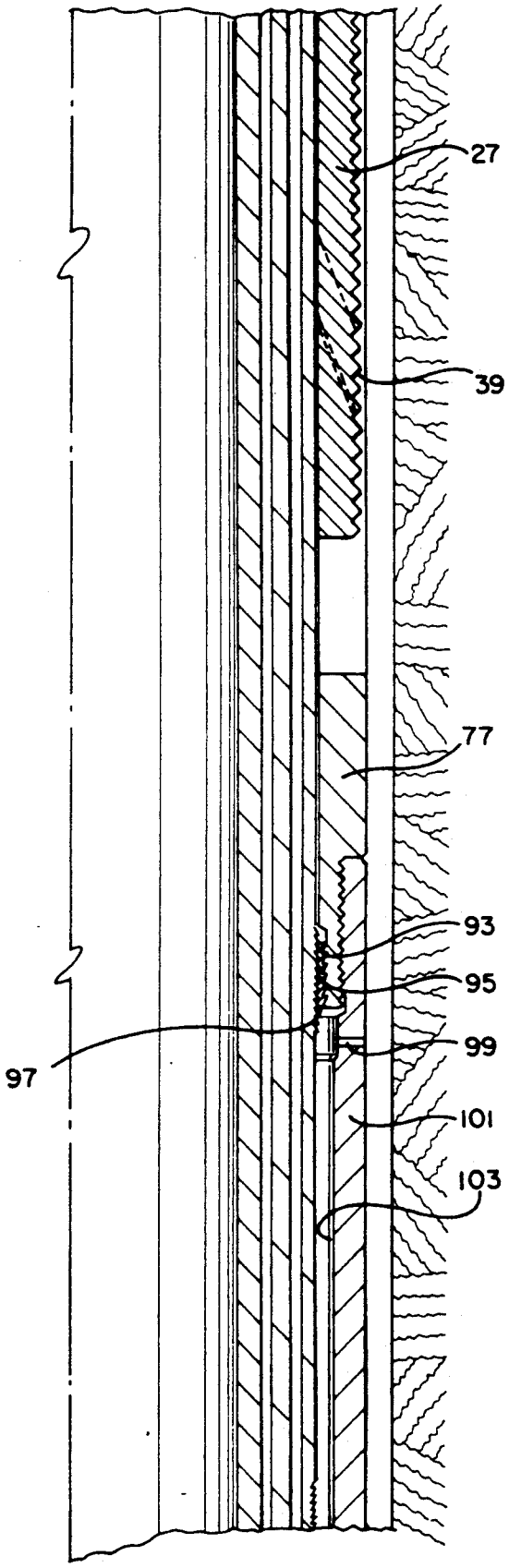
FIG. 6*b* is a downward continuation of the tool of FIG. 6*a*.

As shown in FIGS. 1 and 5*a*, each of the axially shiftable slips 27 has opposing side edges 29, 31 which are adapted to engage mating profiles 33, 35 formed in the longitudinally disposed slots 21, 23, whereby the slots form guideways for the slips for shifting the slips upwardly or downwardly (depending upon the slip orientation) and outwardly relative to the outer body 19 between a set position (FIG. 5*c*) engaging the circumscribing conduit and an unset position (FIG. 5*a* and FIGS. 6*a* and 6*b*). The structure and operation of the slots and guideways for the slips 25, 27 are described in greater detail in the previously mentioned U.S. Pat. No. 4,711,326, issued Dec. 8, 1987, entitled SLIP GRIPPING MECHANISM, assigned to the assignee of the present invention, the disclosure of which is incorporated herein by reference.

As shown in FIG. 1, each of the improved slips 27 of the invention has a lower surface 37 and an upper gripping surface 39 with a plurality of rows of wicker teeth 41 which run generally transverse to the longitudinal axis 43 of the slip 27. The upper gripping surface 39 of the slip is defined between a leading edge 45 and a trailing edge 47, thereof, the upper gripping surface 39 being formed on a longitudinal radius (49 in FIG. 2) which is drawn from a center point 51 located in a plane parallel to the central longitudinal axis (17 in FIG. 6*a*) of the cylindrical conduit 13). Since the upper gripping surface is drawn on a longitudinal radius 49, it assumes a gently sloping arcuate appearance when viewed in cross section in FIG. 2, giving the slip an outwardly protruding mid-section which tapers out in either of opposite directions. The curvature of the slip 27 is shown in slightly exaggerated fashion in FIG. 2 for ease of illustration. In an actual example of a slip 27 (FIG. 2) having an overall length of 10.265 inches intended to suspend a cylindrical conduit within a surrounding 8⅝ inch I.D. casing, the longitudinal radius 49 forms an arc of a circle having an 87.64 inch radius.

As best seen in FIG. 2, the arcuate upper surface results in a slip body 53 of variable cross-sectional thickness, the lower surface 37 being generally planar. The cross-sectional thickness of the slip body 53 increases to a maximum thickness at a point 55 on a row of wicker teeth 41 which is intermediate the leading and trailing edges 45, 47 of the upper gripping surface 39. Preferably, the point of maximum thickness 55 is located approximately midway between the leading and trailing edges 45, 47, whereby the wicker teeth 41 in the row at the point of maximum thickness are first to contact the interior bore 15 of the circumscribing conduit when the slips are shifted axially and radially outward with respect to the outer body 19 of the well tool. The point of maximum thickness 55 is also the approximate center point of the arc which is defined by the longitudinal radius 49 drawn from the center point 51 about the upper gripping surface of the slip 27.

As shown in FIGS. 5*a*–5*c*, each slip 27 is preferably provided as a generally triangular shaped member which is adapted to be received within a mating triangular shaped slot provided as a part of the cylindrical conduit to be supported within the surrounding well bore. The opposing side edges 29, 31 of each slip 27 are preferably provided with radially extending ears 57, 59 which are adapted to be received within channels 61, 63 formed as a part of the mating slots 33, 35 for holding the slips within the slots as the tool is being run to the desired location within the well bore. Openings 65, 67 which communicate the upper and lower surfaces of each slip are used for fixture location during manufacturing.

As shown in FIGS. 5*a*–5*c*, the improved slips of the invention are preferably provided in identical, but oppositely arranged pairs, each slip having a T-shaped rear extent 69, 71 which is engaged within a mating opening provided within a connecting ring 73 which is carried about the exterior of the cylindrical conduit 13. A shearable connection, such as pin 75, also initially connects the upper body portion 79 of the tool to the connecting ring 73 so that the upper slip 25, upper body portion 79 and connecting ring 73 can all move downwardly as a unit to cause the lower slips 27 to ride downwardly within the slot 23 between the unset position shown in FIG. 5a and the set position shown in 5b.

A variety of setting means can be employed for effecting the opposite relative motion between the outer body and slips in order to move the slips from the unset to the set positions illustrated in FIG. 5a-5c. FIGS. 6a and 6b illustrate the operative portions of one such setting means which is described greater detail in copending application, Serial No. 574,435, filed Aug. 28, 1990, for PACK-OFF WELL APPARATUS AND METHOD, assigned to the assignee of the present invention, the disclosure of which has 14 previously been incorporated herein by reference. The setting mechanism illustrated in FIGS. 6a and 6b includes the axially slidable upper body portion 79. The upper body portion 79 circumscribes the cylindrical conduit 13 to be supported within the surrounding well casing 15 and includes an internal groove 81 which contains a support ring 83. The support ring 83 includes a support shoulder 85 which engages the mating shoulder 87 provided on the external diameter of the downwardly extending portion of the cylindrical conduit 13.

In the particular setting mechanism illustrated in FIGS. 6a-6b, the well tool has a longitudinal passageway 89 for communicating hydraulic pressure to a setting chamber (not shown) in order to act upon and effect axial movement of the upper body portion 79 of the setting mechanism in the direction of the lower body portion 77 which remains stationary.

Hydraulic setting pressure can be generated, for example, by actuating an explosive, gas generating charge which compresses hydraulic fluid within the passageway 89. The lower body portion 77 includes an internal wicker surface 93 carrying a body lock ring 95. The body lock ring 95 has an external wicker surface which engages a mating serrated surface 97 provided on the exterior of the downwardly extending portion 13 of the cylindrical conduit. A vent port 99 is also provided in the cylindrical sidewall of the circumscribing member 101, the vent port 99 providing communication between an annular space 103 and the exterior of the device.

During the setting operation, the upper slips 25 and setting ring 73 (FIG. 5a) move downwardly as a unit, causing the lower slips 27 to move axially downward, whereby the lower slips 27 ride up the respective ramp surfaces provided in the slots 23. The mating profiles formed in the longitudinally disposed slots form ramp surfaces which present a tapered incline in the range from about 15 to 25 degrees with respect to the slot lower edge surfaces. In the preferred embodiment illustrated, the slips travel up an approximate 20° ramp angle within the slots 23. This causes the gripping surfaces 39 to travel radially outward and grip the surrounding interior bore 15 of the well casing. After the lower slips 27 begin to grip the surrounding casing, the shearable connection 75 is severed and the upper slips 25 are driven up the ramp surface of the slots 21, thereby causing outward radial movement of the upper slips to grip the surrounding casing. The exact setting mechanism of the gripping slips will be familiar to those skilled in the art and is described, for instance, in U.S. Pat. No. 4,711,326, previously mentioned and incorporated herein by reference. The movement of the slip gripping mechanism between the unset and set positions is illustrated in FIGS. 5a-5c.

The advantages of the present invention are best illustrated with respect to FIGS. 3 and 4. FIG. 3 illustrates a prior art slip 107 having an upper gripping surface 109 provided with a plurality of rows of wicker teeth for engaging a surrounding well casing 111. The prior art slip tends to first make contact with the surrounding casing along the entire length of its upper gripping surface. As a result, the required radial force necessary to make the teeth bite the casing was so great that the slip tended to slide, rather than grip. As the surrounding casing was bowed out under the applied load, it tended to assume a barrel-shaped configuration (FIG. 3). The prior art slip then made contact with the casing only at the outer most extents 113, 115.

FIG. 4 is a schematic illustration of the slip gripping mechanism of the invention in which each slip in the pair is provided with the outer profile previously described. As a result, each slip will make contact on the center row of wicker teeth 119, 121 as a low load is applied during the setting operation. At a high applied load, the slips will conform to the casing contour with all of the rows of wicker teeth making even contact to more evenly distribute the slip loading.

An invention has been provided with several advantages The external profile of the slips used in the slip gripping mechanism allows the slip loading to be more evenly distributed over the upper gripping surface of the slips in order to minimize the resulting stress in the surrounding well casing. Because of the profile of the upper gripping surface, the slips of the invention serve to minimize the setting force required to achieve penetration of the slips into the casing as the load is applied during the setting operation. Because the number of wicker teeth contacting the casing is reduced at low applied setting loads, the required setting force is reduced. Because the slip configuration conforms to the stressed configuration of the casing, the stress is more evenly distributed at heavy applied setting loads.

While the invention has been shown in only one of its forms, it is not thus limited but is susceptible to various changes and modifications without departing from the spirit thereof.

What is claimed is:

1. A slip gripping mechanism for supporting a cylindrical conduit of the type having a central longitudinal axis within the interior bore of a circumscribing conduit in a well bore, comprising:

an outer body provided as a part of the cylindrical conduit, the outer body having a plurality of circumferentially spaced, longitudinally disposed slots;

a plurality of circumferentially spaced, axially shiftable slips carried on the outer body of the cylindrical conduit in the longitudinally disposed slots, each slip having a longitudinal axis and opposing side edges which engage mating profiles formed in the longitudinally disposed slots, whereby the slots form guideways for the slips for shifting the slips axially and radially outward relative to the outer body between a set position engaging the circumscribing conduit and an unset position;

setting means for effecting opposite relative motion between the outer body and the slips; and wherein each of the axially shiftable slips has a lower surface and an upper gripping surface with a plurality of rows of wicker teeth which run generally transverse to the longitudinal axis of the slip, and wherein at least selected ones of the axially shiftable slips has an upper, gripping surface which is formed on a longitudinal radius drawn from a center point located in a plane parallel to the central longitudinal axis of the cylindrical conduit, the upper gripping surface of each slip being defined between a leading edge and a trailing edge thereof, and wherein the longitudinal radius which is used to draw the upper, gripping surface of each slip is drawn to bisect the leading and trailing edges thereof.

2. A slip gripping mechanism for supporting a cylindrical conduit of the type having a central longitudinal axis within the interior bore of a circumscribing conduit in a well bore, comprising:

an outer body provided as a part of the cylindrical conduit, the outer body having a plurality of circumferentially spaced, longitudinally disposed slots;

a plurality of circumferentially spaced, axially shiftable slips carried on the outer body of the cylindrical conduit in the longitudinally disposed slots, each slip having a longitudinal axis and opposing side edges which engage mating profiles formed in the longitudinally disposed slots, whereby the slots form guideways for the slips for shifting the slips axially and radially outward relative to the outer body between a set position engaging the circumscribing conduit and an unset position;

setting means for effecting opposite relative motion between the outer body and the slips; and wherein each of the axially shiftable slips has a lower surface and an upper gripping surface with a plurality of rows of wicker teeth which run generally transverse to the longitudinal axis of the slip, and wherein at least selected ones of the axially shiftable slips has an upper, gripping surface which is formed on a longitudinal radius drawn from a center point located in a plane parallel to the central longitudinal axis of the cylindrical conduit; and wherein each of the axially shiftable slips has a slip body with a cross-sectional thickness defined between a generally planar lower surface and the upper gripping surface thereof, the upper gripping surface of each slip being defined between a leading edge and a trailing edge thereof, and wherein the cross-sectional thickness of the slip body increases to a maximum thickness at a point located intermediate the leading and trailing edges of the upper gripping surface.

3. The slip gripping mechanism of claim 2, wherein the maximum thickness point of the upper gripping surface of each slip is located approximately mid way between the leading and trailing edges thereof.

4. The slip gripping mechanism of claim 3, wherein the axially shiftable slips are provided as identical but oppositely arranged pairs, each of the slip pairs being aligned within a mating pair of the longitudinally disposed slots provided on the outer body.

5. The slip gripping mechanism of claim 4, wherein the mating profiles formed in the longitudinally disposed slots comprise ramp surfaces which present a tapered incline in the range from about 15 to 25 degrees with respect to a slot lower edge surface of each slot, whereby the slots form guideways for the slips for shifting the slips upwardly and outwardly relative to the cylindrical conduit.

6. A slip gripping mechanism for supporting a cylindrical conduit of the type having a central longitudinal axis within the interior bore of a circumscribing conduit in a well bore, comprising:

an outer body made up as a part of the cylindrical conduit which extends from the surface to a subterranean location within the well bore, the outer body having a plurality of circumferentially spaced, longitudinally disposed slots;

a plurality of circumferentially spaced, axially shiftable slips carried on the outer body of the cylindrical conduit in the longitudinally disposed slots, each slip having a longitudinal axis and opposing side edges which engage mating profiles formed in the longitudinally disposed slots, whereby the slots form guideways for the slips for shifting the slips axially and radially outward relative to the outer body between a set position engaging the circumscribing conduit and an unset position;

setting means for effecting opposite relative motion between the outer body and the slips; and wherein each of the axially shiftable slips has a lower surface and an upper gripping surface defined between a leading edge and a trailing edge thereof, each upper gripping surface having a plurality of rows of wicker teeth which run generally transverse to the longitudinal axis of the slip, each of the slip upper, gripping surfaces being formed on a longitudinal radius drawn from a center point located in a plane parallel to the central longitudinal axis of the cylindrical conduit, whereby each slip has a slip body of variable cross-sectional thickness, the cross-sectional thickness of each slip body increasing to a maximum thickness at a point located on a row of wicker teeth intermediate the leading and trailing edges of the upper gripping surface, whereby the wicker teeth of the intermediate row are first to contact the interior bore of the circumscribing conduit when the slips are shifted axially and radially outward with respect to the outer body.

7. An improved slip of the type adapted for use as a part of a slip gripping mechanism used to support a cylindrical conduit within the interior bore of a circumscribing conduit in a well bore, the improved slip comprising:

a generally planar slip body having a longitudinal axis and opposing side edges and having a generally planar, lower surface and an upper gripping surface defined between a leading edge and a trailing edge thereof, the upper gripping surface having a plurality of rows of wicker teeth which run generally transverse to the longitudinal axis of the slip, and wherein the cross-sectional thickness of the slip body increases to a maximum thickness at a point located intermediate the leading and trailing edges of the upper gripping surface.

8. The improved slip of claim 7, wherein the cross-sectional thickness of the slip body increases to a maximum thickness at a point located approximately mid way between the leading and trailing edges of the upper gripping surface thereof.

9. The improved slip of claim 8, wherein the opposing side edges of the slip body are tapered to engage mating profiles formed in longitudinally disposed slots provided as a part of the cylindrical conduit, whereby the slots form guideways for the slips for shifting the slips axially and radially outward relative to the cylindrical conduit between a set position engaging the circumscribing conduit and an unset position.

10. The improved slip of claim 9, wherein each slip has a generally triangular upper gripping surface which is adapted to be received within a mating triangular shaped slot provided as a part of the cylindrical conduit, the opposing side edges of slip also having radially extending ears which are adapted to be received within channels formed as a part of the mating slots for holding the slips within the slots.

* * * * *